United States Patent [19]

Zuend

[11] Patent Number: 4,566,152

[45] Date of Patent: Jan. 28, 1986

[54] METHOD OF REMOVING FLOCKS FROM FIBER BALES

[75] Inventor: Marcel Zuend, Winterthur, Switzerland

[73] Assignee: Rieter Machine Works, Winterthur, Switzerland

[21] Appl. No.: 484,421

[22] Filed: Apr. 12, 1983

[30] Foreign Application Priority Data

May 4, 1982 [CH] Switzerland ..... 2719/82

[51] Int. Cl.[4] ..... D01G 7/06; D01G 13/00

[52] U.S. Cl. ..... 19/81; 19/145.5; 414/273

[58] Field of Search ..... 19/80 R, 81, 80, 145.5; 414/273

[56] References Cited

U.S. PATENT DOCUMENTS 3,951,282 4/1976 Keller ..... 19/80 R
4,087,882 5/1978 Keller ..... 19/81 X
4,363,585 12/1982 Keller et al. ..... 19/80 R
4,382,316 5/1983 Goldammer et al. ..... 19/81

*Primary Examiner*—Louis K. Rimrodt
*Attorney, Agent, or Firm*—Kenyon & Kenyon

[57] ABSTRACT

The removal of flocks from the series of fiber bales is controlled by a control signal which is generated in response to a deviation from a predetermined ratio of the operating time intervals and the non-operating time intervals of the flock removal member. Flock material is continuously withdrawn from the storage receiver while delivery of flock is controlled by stop and start signals (a, e) which are produced in response to the receiver achieving maximum fill or minimum fill. A determination is made of the operating time interval between a start signal and a succeeding stop signal while a non-operating time period is determined between the stop signal and the next succeeding start signal in order to obtain the control signal.

12 Claims, 2 Drawing Figures

Figure 1:
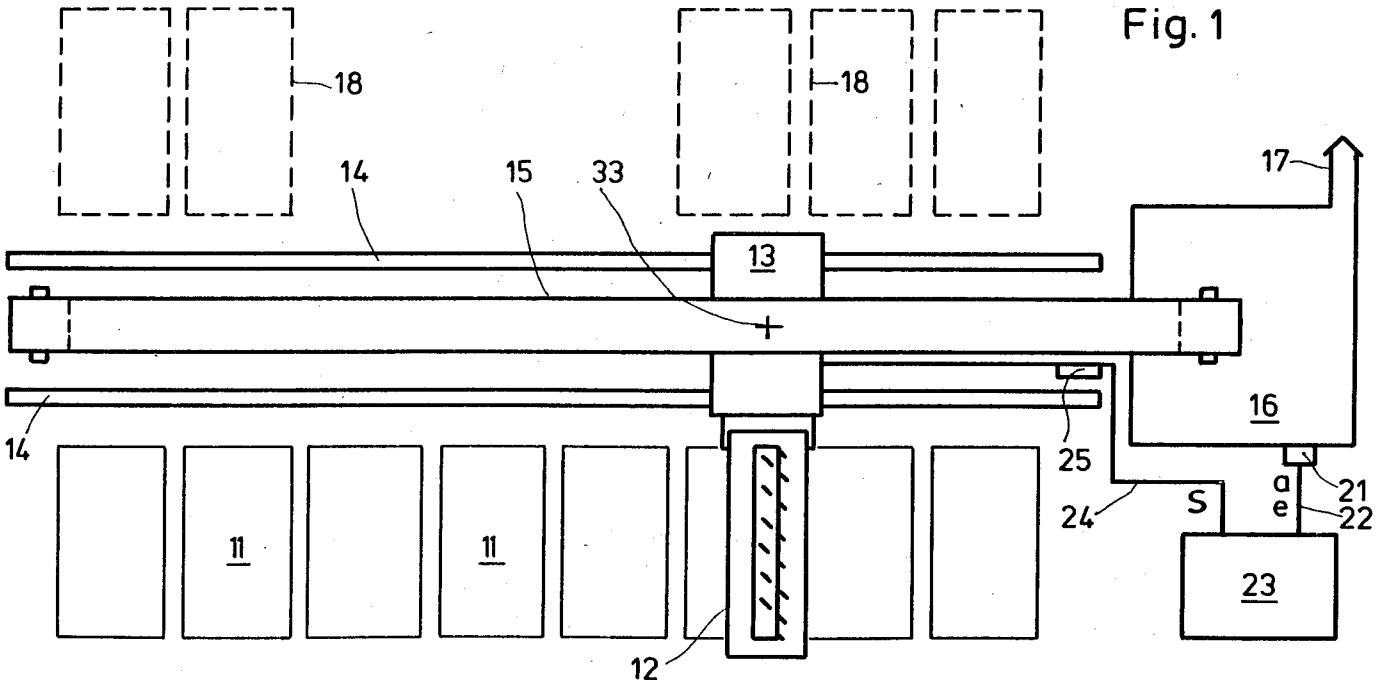

17
21
22
26
a
e
15
16
32
y
30
a, e
27
24
s
a, e
28
j
31

METHOD OF REMOVING FLOCKS FROM FIBER BALES

This invention relates to a method and apparatus of removing flocks from a series of fiber bales.

As is known, various techniques have been used for removing fiber flocks from fiber bales for use in various processes for processing fiber into yarn.

For example, it has been known to remove fiber flocks from a series of fiber bales which are set out on a support surface by repeatedly guiding a fiber removal member above the bales. In this case, the fiber material is picked up by the removal member and carried away as fiber flocks freely and continuously, for example to a suction duct. In this process, the removal member generally moves with a constant speed over the bales, and after each pass, is adjusted in height through a constant increment. Thus, on each pass, a layer of flock material corresponding to the height adjustment is removed from the bales. In this regard, it has also been known, as described in the periodical "Melliand Textilberichte" January, 1982, page 15, to use micro-electronics for sensing the height of the bales presented for flock removal and for setting the removal depth per bale group, for example for blending different fibers. After removal, the flock material has been transported to a storage receiver and subsequently transported from there to subsequent processing machines such as cards, drafting mechanisms and combing machines.

Generally, it is desired to supply the processing machines with flock material without interruption. Accordingly, the flock material must be continuously available in the receiver. This is ensured by feeding somewhat more flock material to the receiver than the following machines require.

In order to avoid overfilling of the receiver, the removal process is usually stopped each time the level of fill of the receiver exceeds a maximum value. Subsequently, when the level of fill in the receiver falls below a minimum value, as a result of the continuous extraction of flocks for the processing machines, the removal process is again started. This results in a periodic stopping and starting of the removal process, that is of the production of flocks.

The periodic stopping and starting of the removal process is considered optimal when the removal process operates for approximately 80–90% of the time and is inoperable for approximately 20%–10% of the time. This time reserve of 10–20% is required, and from experience, is sufficient in order, amongst other things, to carry out required maintenance work or, in a working procedure with two rows of bales from which flock are to be removed alternately, in order to carry out the rotation of the removal member through 180 degrees from the depleted row of bales to the full row of bales.

It is known that the bales from which fibers are to be removed are not of the same density throughout their height. They are densest in their middle region. Thus, during flock removal from the uppermost and lowermost parts of the bale, less flocks are delivered in terms of weight than during flock removal from the middle part of the same bale. In the past, this has meant that less material in terms of weight per unit time is fed to the storage receiver at the start and at the end of the bales than during flock removal in the middle region of the bales. Accordingly, the removal machines operate at the beginning and end of the bales for longer time intervals than in the case for flock removal from the middle region of the bales.

In order to ensure an uninterrupted delivery of flocks from the receiver with the known equipment, the optimal non-operating level of 10–20% of the working time is designed for the beginning and end of the bales. Thus, the non-operating periods of the removal roller become too long during flock removal from the middle region of the bales. This is not economical because the blowing room machines are not sufficiently utilized.

Accordingly, it is an object of the invention to provide a process for efficiently removing fiber materials from a series of fiber bales.

It is another object of the invention to provide an economical system for removing fiber flocks from fiber bales.

It is another object to the invention to more efficiently utilize the machines for removing fiber flocks from fiber bales.

Briefly, the invention provides a method and apparatus for removing flocks from at least one series of fiber bales disposed along a support surface.

In accordance with the method, a flock removal member is moved to and fro in a sequence of passes over a series of fiber bales to remove the fiber in the form of flocks while lowering the flock removal member after each pass. The removed flock is then fed into a storage receiver for subsequent transporting to a processing stage.

In addition, a stop signal is generated for stopping the feeding step in response to the receiver reaching a maximum level of fill and a start signal is generated for restarting the feeding step in response to the receiver reaching a minimum level of fill.

In accordance with the invention, a determination is made of the operating time interval (Ta) lasting from one start signal to a succeeding stop signal and a non-operating time interval (Ts) lasting from each stop signal to a succeeding start signal. Next, each operating time interval is compared with a non-operating time interval in a given operating cycle in order to obtain a monitoring signal (y) dependent on the time intervals of the cycle. Each monitoring signal is then compared with a predetermined reference signal and a control signal is formed in response to a difference between the monitoring signal and the reference signal. The control signal is then used to adjust the movement of the flock removal member in order to control the weight of the flock removed from the fiber bales per unit of time.

The apparatus for removing the flocks includes a means for moving the flock removal member across the fiber bales in order to remove flock, a storage receiver and means connected to the receiver to transport the flock from the receiver In addition, a monitoring installation is provided at the receiver for generating the stop and start signals and an electrical circuit is connected between the monitoring installation and the means for moving the flock removal member so as to deliver the start and stop signals to this means for starting and re-starting purposes. In addition, a means is provided for comparing the operating time interval (Ta) with the non-operating time intervals (Ts) in order to obtain the monitoring signal (y) and a comparator is provided for comparing the monitoring signal with the reference signal in order to generate the control signal. This comparator is connected to the means for moving the flock removal member in order to deliver the control signal thereto for adjustment purposes.

In accordance with the invention, flock removal from the dense portion of the bales, which forms the greater part of the flock material of the bales, is carried out in relatively thin layers. This implies a gentler opening of the bales with smaller flocks. The influence of the inhomogeneity of the bales is practically eliminated. On the other hand, the continual matching to the optimal non-operating times can be used to raise the overall production of the flock removal machine in comparison with the known flock removal machines, yet with a flock quality which is the same as that achieved by these known machines.

Figure 2:
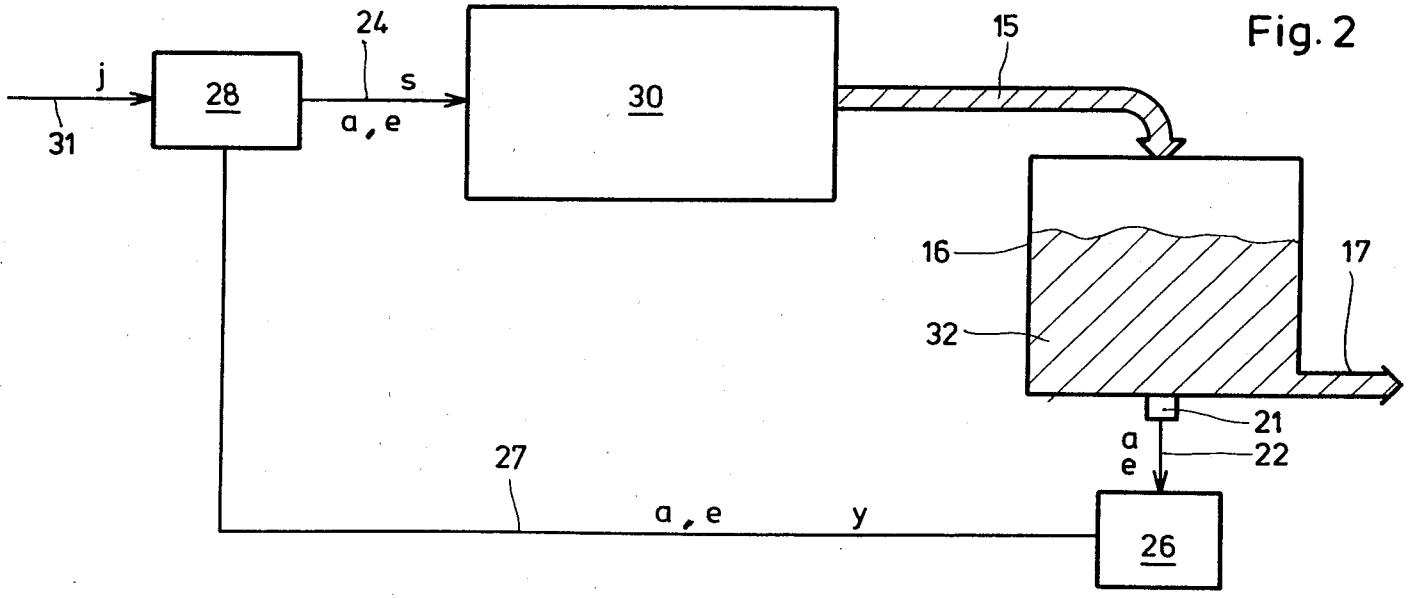

These and other objects and advantages of the invention will become more apparent from the following description taken in conjunction with the accompanying drawings wherein:

FIG. 1 illustrates a schematic view of an apparatus for removing flocks from two rows of fiber bales as viewed from above; and FIG. 2 schematically illustrates a control system according to the invention.

Referring to FIG. 1, a series of fiber bales 11 is disposed along and on a supported surface with a flock removal member 12 arranged above the bales 11. This flock removal member 12 is carried on a suitable means such as a carrier 13 which serves to move the removal member 12 to and fro in a sequence of passes over the fiber bales 11. To this end, the carrier 13 is movable along rails 14 via a motor (not shown). In addition, the removal member 12 is adjustable in height, for example, for removing a greater or less thickness of fiber material from the bales 11.

A transport duct 15 is disposed over the carrier 13 in order to take up the flocks removed from the bales 11 by the removal member 12 and to feed these flocks to a storage receiver 16. From the receiver 16, the fiber flocks pass through a means, such as a duct 17, to suitable processing machines (not shown) as is known.

As shown in FIGS. 1 and 2, a monitoring installation 21 is connected at the receiver 16 for generating a start signal a in response to the receiver 16 reaching a predetermined minimum level of fill as well as a stop signal e in response to the receiver 16 reaching a maximum level of fill. As indicated in FIG. 1, the signals a and e pass via an electrical lead 22 to an electrical circuit 23 and are further delivered via a lead 24 from the circuit 23 to the carrier 13 for starting and stopping the carrier 13.

As indicated in FIG. 1 a device 25 is provided intermediately of the lead 24 in order to permit the length of the lead 24 to be increased while the carrier 13 is moved to the left, as viewed, and to take up the released lead 24 upon movement of the carrier 13 to the right, as viewed.

Referring to FIG. 2, the electrical circuit 23 includes a circuit arrangement 26 which receives the start and stop signals a, e, a computer 28 in the form of a comparator and a lead 27 which connects the circuit arrangement 26 to the computer 28. The means for moving the flock removal member is illustrated schematically as a unit 30. The flock material 32 in the duct 15 and receiver 16 is indicated by hatching As indicated in FIG. 2, the start and stop signals a, e are delivered directly to the means 30 for moving the flock removal member. In addition, the circuit arrangement 26 is constructed so as to determine an operating time interval Ta lasting from one start signal a to a succeeding stop signal e as well as a non-operating time interval Ts lasting from each stop signal e to the succeeding start signal a. In addition, the circuit arrangement 26 includes means for comparing each operating time interval Ta with a non-operating time interval Ts in a given operating cycle (formed by the successive time intervals) in order to obtain a monitoring signal y dependent upon the time intervals of the operating cycle. As indicated in FIG. 2, the circuit arrangement 26 delivers the monitoring signal y via the lead 27 to the computer 28.

As shown in FIG. 2 the computer 28 also receives a predetermined reference signal j via an input line 31. In operation, the computer 28 compares each received monitoring signal y with a reference signal j and forms a control signal s in response to a difference between the monitoring signal y and the reference signal j.

The produced control signal s is delivered via the lead 24 to the means 30 for moving the flock removal member (or to the carrier 13) in order to adjust the movement of the flock removal member and thus control the weight of the flock removed from the fiber bales 11 per unit of time.

As shown in FIG. 1, a second row of bales 18 is located opposite the row of bales 11. In this embodiment, the bales 18 are brought up and laid down during flock removal from the bales 11. When the bales 11 are depleted, the removal member 12 is pivoted through 180 degrees about a vertical axis of rotation 33. Thereupon, flock removal from the row of bales 18 is started. When the bales 18 are depleted, the removal member 12 is again pivoted to a fresh row of bales 11 and the flocks removed therefrom.

In operation, the carrier 13 with the removal member 12 travels to and fro on the rails 14. During this time, flock material is taken from the bales 11 by the rotating removal member 12. This flock material 32 travels through the transport duct 15 into the receiver 16. After each pass, the removal member 12 is lowered through a determined increment so that on each pass a layer of fiber material is removed which is of a thickness equal to the increment through which the removal member 12 was lowered.

During operation, the quantity of flock material 32 entering the receiver 16 from the transport duct 15 per unit time is somewhat greater than the quantity of flock material 32 removed per unit time through the duct 17. As soon as a predetermined maximum level of fill is achieved in the receiver 16, the monitoring installation 21 delivers a stop signal e. This passes via the leads 22, 27 and 24 directly to the flock removal machine 30 and effects stopping of the flock production or the flock removal process. In the meantime, the removal of flock material 32 from the receiver 16 continues. When a predetermined, minimum level of fill of the receiver 16 is reached, a start signal a is emitted from the monitoring installation 21. This passes, like the stop signal e, via the leads 22, 27 and 24 directly to the flock removal machine 30 and effects re-starting thereof.

During normal operating of the flock removal machine 30, a determination is made of the operating time intervals Ta lasting from each start signal a until the immediately succeeding stop signal e, and the non-operating time intervals Ts lasting from each stop signal e until the immediately succeeding start signal a. One operating time interval Ta and one immediately succeeding non-operating time interval Ts are referred to as one operating cycle. In the circuit arrangement 26, a monitoring signal y is formed which is dependent upon the time intervals Ta and Ts, that is as a function of the magnitudes Ta and Ts. The reference signal j defines a predetermined desired relationship of the values Ta and Ts to each other. For example, where the operating time interval Ta is to be four times the non-operating time interval Ts (that is Ta forms 80% and Ts forms 20% of the time period of an operating cycle), then the reference signal j has a particular value. Upon a change in the value of Ta, supplied by the monitoring installation 21, in relation to Ts, the signal y will change.

The monitoring signal y and the reference signal j are compared with each other in the computer 28 and a control signal s is produced which is a function of the deviation of the values Ta and Ts from their desired mutual relationship-predetermined by the signal j. This signal s controls the device provided in the flock removal machine 30 to control the removal process of the removal member 12 in such manner that the flock production (that is, the weight of flocks removed per unit time from the fiber bales 11 by the removal member 12) is adjusted in such a sense that the desired relationship of Ta and Ts given by the reference signal j is obtained.

Upon transfer of flock removal from the upper to the middle range of the bales 11, the control signal s produces a weight reduction of the flock material picked up by the roller 12 per unit time, for example by a reduction of the height adjustment of the removal member 12 per pass, that is per operating cycle. Correspondingly, upon transfer of flock removal from the middle to the lower region of the bales 11, the control signal s produces a weight increase of the flock material picked up by the roller 12 per unit time, for example by an increase in the height adjustment of the removal member 12 per passage.

Such a weight reduction or increase in the quantity of flock material removed per unit time is achievable not only by the just mentioned reductions or increases in the degree of lowering before the passages of the flock removal member. For example, instead of an increase or reduction of the degree of lowering, the time intervals between successive passes of the flock removal member 12 can also be increased or reduced. A change in the time of passage of the moving flock removal member 12, for example by change of the speed of movement of the carrier 13 also represents a possibility for variation.

By controlling the flock removal machine 30 by means of the control signal s, the weight of the flocks removed from the fiber bales 11 per unit time by the flock removal member 12 is changed. If this weight is increased, then the receiver 16 is filled more quickly so that the number of non-operating time intervals Ts increases. If this weight is reduced, then the number of these intervals Ts is reduced.

In one particular embodiment a monitoring signal y is formed in the circuit arrangement 26 which is porportional to the expression Ta/(Ta+Ts). Under the conditions in which the operating time intervals Ta represent 80% of the period of an operating cycle and the non-operating time intervals Ts represent 20% of that period, the expression Ta/(Ta+Ts) takes the value 0.8. In such a case, the computer, 28 forms from the reference signal j and the monitoring signal y, a control signal by means of which the flock removal machine 30 is controllably held to the value 0.8 by adjustment of the flock quantity removed per unit time. The use of the expression Ta/(Ta+Ts) as a basis for the formation of the control signal s produces the advantage of a simpler and reliable operating circuit.

The invention thus provides a method of removing flocks from a series of fiber bales which permits an efficient operation of the removal apparatus.

Further, the invention provides a relatively simple apparatus for obtaining an efficient operation of the flock removal apparatus.

The invention further provides for a better utilization of the flock removal member and a more gentle opening of the bales. In addition, the invention permits smaller fiber flocks to be removed as well as a higher rate of production of the flock removal member.

I claim:

1. A method of removing flocks from at least one series of fiber bales disposed along a support surface, said method comprising the steps of moving a flock removal member to and fro in a sequence of passes over the fiber bales;

lowering the flock removal member for each pass over the fiber bales;

feeding the removed flock into a storage receiver at a first quantity of weight per unit of time;

transporting the flock in the storage receiver to a processing stage at a second quantity of weight per unit of time less than said first quantity;

generating a stop signal for stopping said feeding step in response to the receiver reaching a maximum level of fill;

generating a start signal for re-starting said feeding step in response to the receiver reaching a minimum level of fill;

determining an operating time interval (Ta) lasting from one start signal to a succeeding stop signal and a non-operating time interval (Ts) lasting from each stop signal to a succeeding start signal;

comparing each said operating time interval with a non-operating time interval in a given operating cycle to obtain a monitoring signal (y) dependent on said time intervals of said cycle;

comparing each monitoring signal with a predetermined reference signal and forming a control signal in response to a difference between said monitoring signal and said reference signal; and adjusting the movement of the flock removal member in response to said control signal to control the weight of the flock removed from the fiber bales per unit of time.

2. A method as set forth in claim 1 wherein said monitoring signal is proportional to the expression Ta/(Ta+Ts).

3. A method as set forth in claim 2 wherein said reference signal has a value of 0.8.

4. A method as set forth in claim 1 wherein the height adjustments of the flock removal member occuring on successive passes are adjusted in magnitude in response to said control signals.

5. A method as set forth in claim 1 wherein the time intervals between passes of the flock removal member over the fiber bales are adjusted in response to said control signals.

6. A method as set forth in claim 5 wherein said time intervals are varied by a change in the speed of movement of the fiber removal member over the fiber bales.

7. A method as set forth in claim 1 wherein the movement of the flock removal member is adjusted to obtain a monitoring signal equal to said reference signal.

8. A method as set forth in claim 7 wherein the lowering of the flock removal member is in response to said control signal.

9. A method as set forth in claim 7 wherein the speed of the flock removal member is varied in response to said control signal.

10. A method of removing flocks from at least one series of fiber bales disposed along a support surface, said method comprising the steps of moving a flock removal member to and fro in a sequence of passes over the fiber bales;

lowering the flock removal member for each pass over the fiber bales;

feeding the removed flock into a storage receiver;

transporting the flock in the storage receiver to a processing stage;

generating a stop signal for stopping said feeding step in response to the receiver reaching a maximum level of fill;

generating a start signal for re-starting said feeding step in response to the receiver reaching a minimum level of fill;

determining an operating time interval (Ta) lasting from one start signal to a succeeding stop signal and a non-operating time interval (Ts) lasting from each stop signal to a succeeding start signal;

comparing each said operating time interval with a non-operating time interval in a given operating cycle to obtain a monitoring signal (y) dependent on said time intervals of said cycle;

comparing each monitoring signal with a predetermined reference signal and forming a control signal in response to a difference between said monitoring signal and said reference signal; and adjusting the movement of the flock removal member in response to said control signal to control the weight of the flock removed from the fiber bales per unit time.

11. A method as set forth in claim 10 wherein said monitoring signal is proportional to the expression $Ta/(Ta+Ts)$.

12. In an apparatus for removing flocks from a series of fiber bales, the combination comprising first means for moving a flock removal member in a sequence of passes across a series of fiber bales to remove flock therefrom;

a storage receiver for receiving the removed flock;

second means connected to said receiver to transport flock from said receiver;

a monitoring installation at said receiver for generating a stop signal in response to said receiver reaching a maximum level of fill and a start signal in response to said receiver reaching a minimum level of fill;

an electrical circuit connected between said monitoring installation and said first means for moving said flock removal member to deliver each respective signal thereto for stopping and re-starting of said first means;

third means for comparing an operating time interval (Ta) lasting from one start signal to a succeeding stop signal with a following non-operating time interval (Ts) lasting from said succeeding signal to a succeeding start signal to obtain a monitoring signal (y); and a comparator for comparing each monitoring signal with a predetermined reference signal to form a control signal in response to a difference between said monitoring signal and said reference signal; said comparator being connected to said first means to deliver said control signal thereto to adjust the movement of said fiber removal member to control the weight of the flock removed from the fiber bales per unit of time.

* * * * *